US009822541B2

(12) United States Patent
Paull

(10) Patent No.: US 9,822,541 B2
(45) Date of Patent: Nov. 21, 2017

(54) DRAINAGE SYSTEM FOR A FIBERGLASS SWIMMING POOL BODY

(71) Applicant: Philip Paull, Noblesville, IN (US)

(72) Inventor: Philip Paull, Noblesville, IN (US)

( * ) Notice: Subject to any disclaimer, the term of this patent is extended or adjusted under 35 U.S.C. 154(b) by 20 days.

(21) Appl. No.: 14/966,143

(22) Filed: Dec. 11, 2015

(65) Prior Publication Data

US 2017/0167153 A1 Jun. 15, 2017

(51) Int. Cl.
*E04H 4/12* (2006.01)
*E04H 4/00* (2006.01)

(52) U.S. Cl.
CPC ..... *E04H 4/1272* (2013.01); *E04H 4/0037* (2013.01); *E04H 4/1245* (2013.01); *E04H 2004/0068* (2013.01)

(58) Field of Classification Search
CPC ..... E04H 4/12; E04H 4/0037; E04H 4/1209; E04H 4/1236; E04H 4/1245; E04H 4/1272; E04H 2004/0068
USPC ..... 4/490, 496, 504, 506–509
See application file for complete search history.

(56) References Cited

U.S. PATENT DOCUMENTS 3,908,206 A * 9/1975 Grewing ..... E04H 4/12 137/426
4,133,059 A * 1/1979 Baker ..... E04H 4/1209 4/494
4,211,249 A * 7/1980 Richards ..... E04H 4/12 137/393
4,445,238 A * 5/1984 Maxhimer ..... E04H 4/12 137/392
4,607,399 A * 8/1986 Yovanofski ..... E04H 4/12 137/412
4,686,718 A * 8/1987 Kinkead ..... E04H 4/1209 137/428
4,724,552 A * 2/1988 Kinkead ..... E04H 4/1209 4/508
4,902,412 A * 2/1990 Surber, III ..... B02C 18/0092 210/167.13

(Continued)

*Primary Examiner* — J. Casimer Jacyna
(74) *Attorney, Agent, or Firm* — C. John Brannon; Brannon Sowers & Cracraft OC

(57) ABSTRACT

A swimming pool assembly plumbed for winterization, including a swimming pool body having a top edge and an oppositely disposed bottom member connected by at least one sidewall, a water outlet operationally connected to the at least one wall and defining a high water level, at least one jet inlet body operationally connected to the at least one wall, first and second conduits connected in fluidic communication with the respective water outlet and at least one jet body, an at least partially buried pipe, a first and second manifolds positioned within the pipe and connected in fluidic communication with the respective first and second conduits; valves operationally connected to the respective manifolds; outlet ports operationally connected to the respective valves, and a drain line positioned in fluidic communication with the respective outlet ports. When the respective valves are open, water may drain from the pool, the respective conduits, through the respective manifolds and through the drain line to allow the pool body to drain to substantially below the high water level to define a winter water level, and when the respective valves are closed, the water level in the pool may be filled to the high water level.

17 Claims, 13 Drawing Sheets

(56) References Cited

U.S. PATENT DOCUMENTS

| | | | | | |
|---|---|---|---|---|---|
| 5,154,205 | A * | 10/1992 | Langill | E04H 4/12 | 137/393 |
| 5,790,991 | A * | 8/1998 | Johnson | E04H 4/12 | 137/423 |
| 6,080,324 | A * | 6/2000 | Pleva | E04H 4/1209 | 210/167.12 |
| 8,266,737 | B1 * | 9/2012 | Goettl | E04H 4/12 | 137/426 |
| 2014/0076814 | A1 * | 3/2014 | Monzingo | E04H 4/1209 | 210/663 |

* cited by examiner

DRAINAGE SYSTEM FOR A FIBERGLASS SWIMMING POOL BODY

TECHNICAL FIELD

The present novel technology relates generally to the field of excavation, and, more particularly, to an in-ground fiberglass swimming pool system wherein excess water may be automatically drained for winterization.

BACKGROUND

Preformed fiberglass swimming pools offer many advantages over in-situ formed shotcrete or concrete walled swimming pools. Fiberglass pool bodies may be quickly and inexpensively formed and require considerably less effort to put into the ground. One drawback associated with fiberglass swimming pools, and swimming pools in general, has been the need for professional winterization of the pools, including blowing out water lines leading into and from the pool and then plugging those now-evacuated lines from the pool side. If this step is improperly performed, repetitive freezing and thawing cycles can cause serious damage to the pool and the associated buried waterlines, requiring expensive and disruptive excavation to repair. Typically, winterization is performed by professionals, and costs several hundred dollars each year to close the pool in the fall and reopen it in the spring.

Thus, there remains a need for a plumbing system and method that would allow easy winterization by the homeowner in the fall and equally easy return to operational status in the spring. The present novel technology addresses this need.

SUMMARY

The present novel technology relates to a method and apparatus for providing a sidewall support and reinforcement system around a fiberglass swimming pool. One object of the present novel technology is to provide an improved fiberglass swimming pool system. Related objects and advantages of the present novel technology will be apparent from the following description.

DETAILED DESCRIPTION OF THE PREFERRED EMBODIMENT

Figure 1:
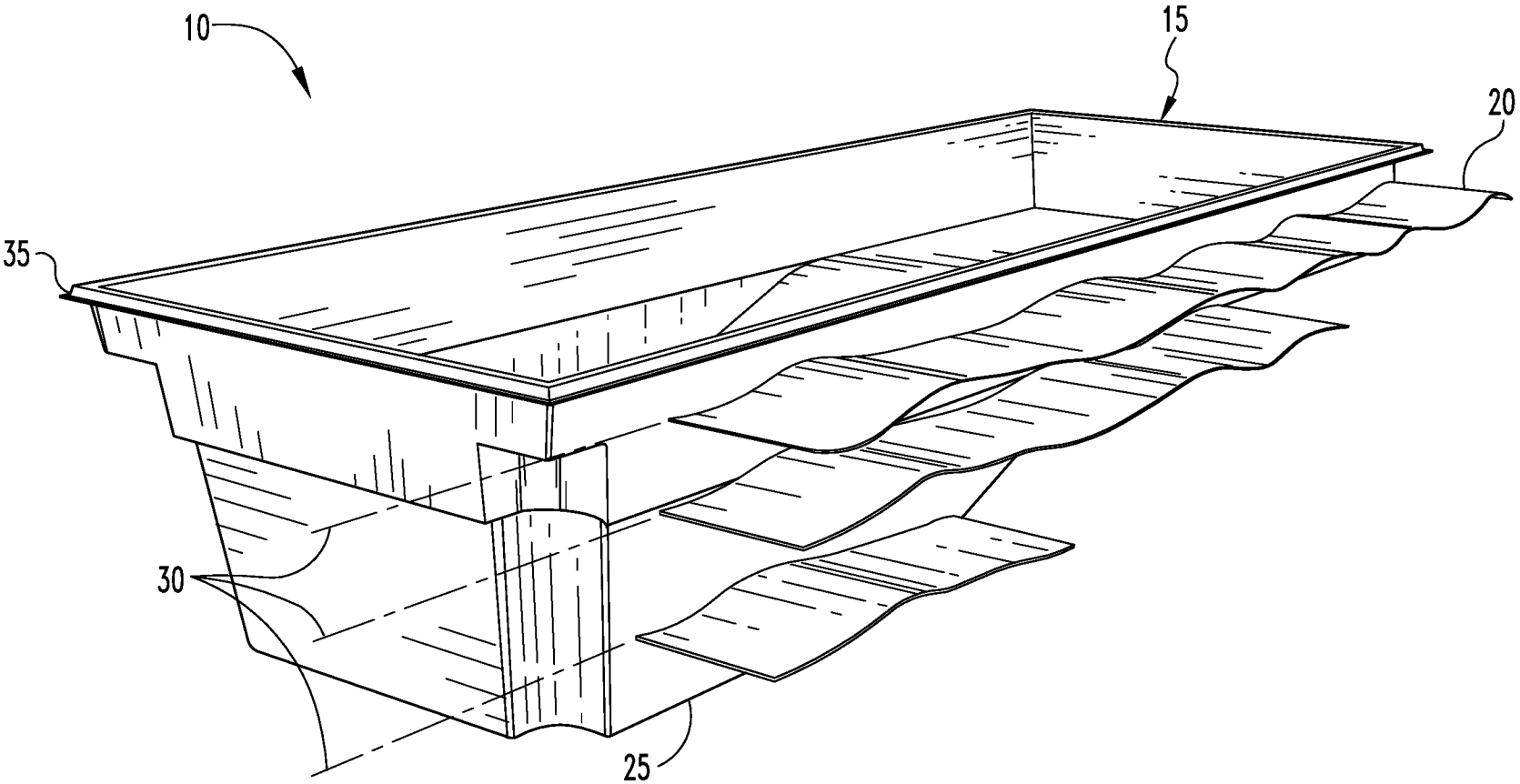
FIG. 1 is a top plan view of a first embodiment fiberglass pool assembly of the present novel technology.
Figure 2:
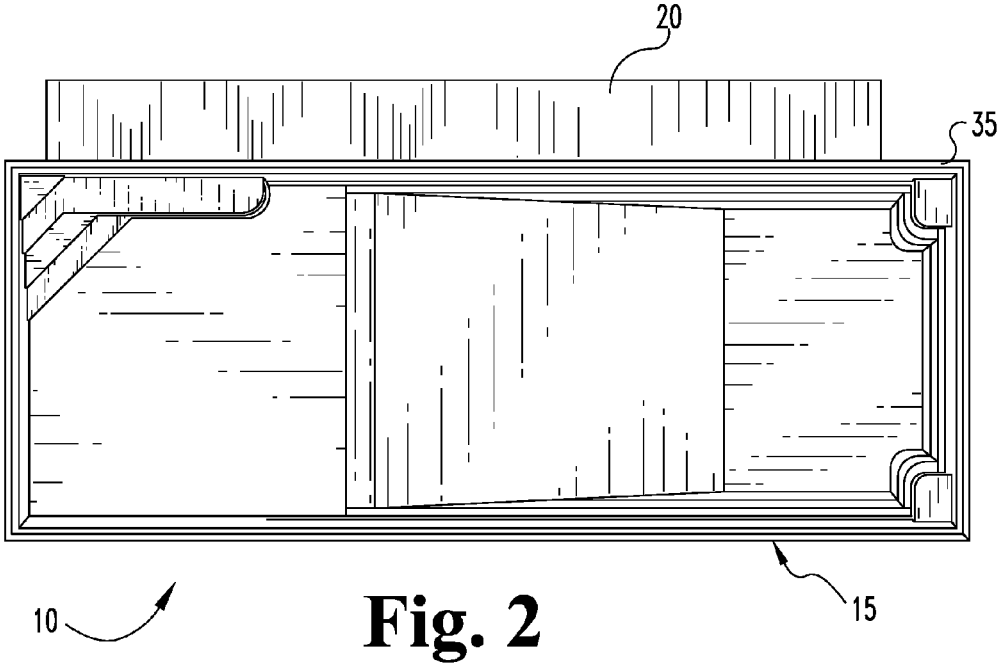
FIG. 2 is a side elevation view of the pool assembly of FIG. 1
Figure 3:
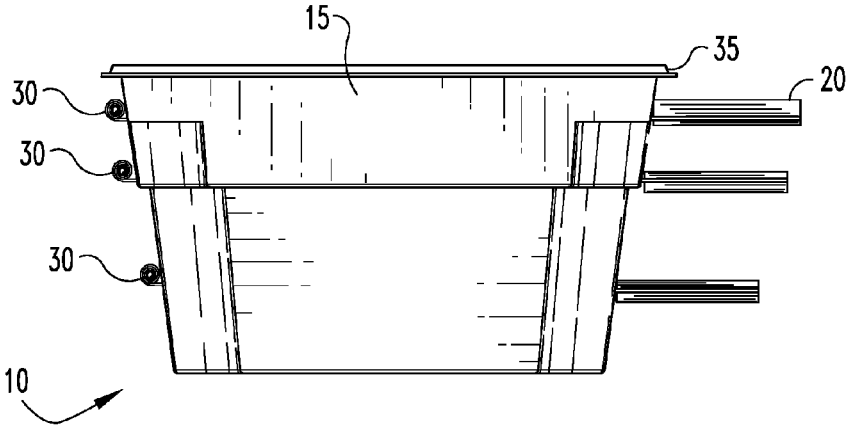
FIG. 3 is a perspective view of the curtain of FIG. 1 having anchor sheets deployed therearound.
Figure 4:
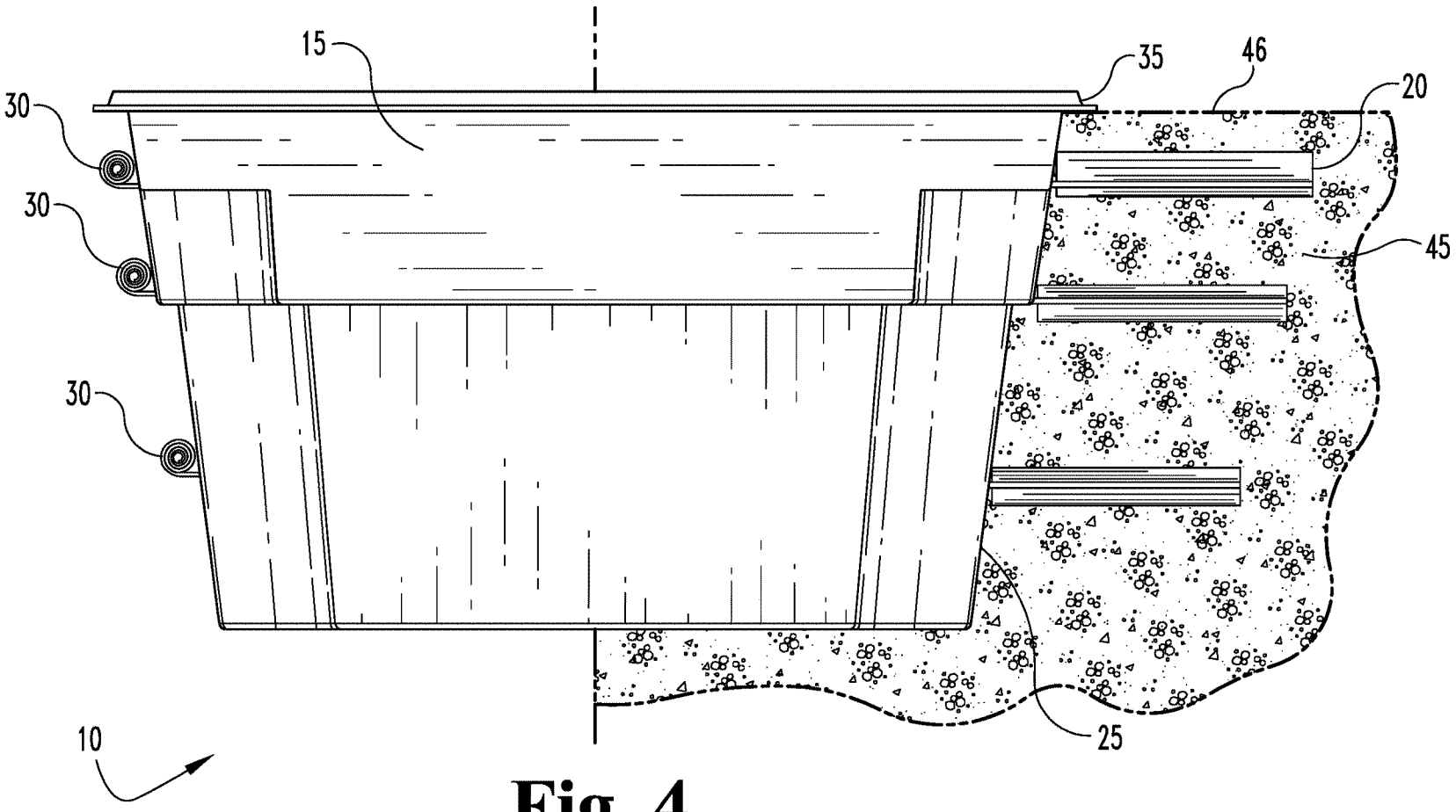
FIG. 4 is a perspective view of the curtain of FIG. 1 having attached anchor sheets rolled up against the pool body.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Geotextiles are stable fabrics designed to not degrade when embedded in soil for extended periods of time. Geotextiles are also permeable so as to allow the passage of fluids therethrough, such that they may be used to provide reinforcement without also creating a drainage problem. Geotextile materials are typically made from polymers such as polypropylenes, polyesters, or the like, and may be formed by such processes as weaving, spin melting, heat bonding, or the like.

The present novel technology relates to a system 10 for mounting or installing a fiberglass or like preformed swimming pool body 15 into a freshly dug excavation, and includes a at least one, and more typically a plurality, of flexible, tough sheet segments 20 securely bonded to one or more exterior sidewalls 25 of the pool body 15 for extension therefrom. Typically, a plurality of geotextile, fiberglass, or like material anchoring sheets 20 are bonded to the pool body 15 at one or more exterior sidewalls 25 at one or more different elevations 30 (distances from the top lip 35 of the pool body 15 when oriented for positioning in the ground) and are spaced around the pool body perimeter. Prior to putting the pool body 15 into the ground, each geotextile sheet 20 is typically rolled up and secured to the pool sidewall 20 for transport and convenience of storing, such as with a zip tie or the like. After the pool body 15 is positioned into the excavation, the excavation around the pool body 15 is backfilled (typically with gravel) to the level of the lowermost sheet(s) 20. The lowermost sheets 20 are unrolled and extended over the backfill surface and are placed thereupon, and additional backfill material (typically soil and/or sand and/or gravel and/or combinations thereof) is backfilled into the excavation onto the extended sheets 20. When the level of backfill material reaches the level of the next set of sheets 20, the sheets 20 at that elevation 30 are likewise extended and the filling process is continued. The weight of the soil pressing on the extended sheets 30, as securely bonded to the fiberglass outer walls 25, is sufficient to generate an outward force on the walls 25 to at least partially counter the inward force produced by the soil around the pool body 15. Optionally, the backfill may be compacted manually or with a mechanical compactor at one or more points during the backfilling process.

The geotextile sheets 20 are typically about a meter wide or long, and typically extend up to about meter from the pool sidewall, more typically about 0.5 meters, and still more typically about 0.25 meters, although the width and length of the sheets 20 may vary from pool body 15 to pool body 15. Likewise, the total number of sheets 20 required will vary with the total surface area of the pool sidewalls 25. In other words, bigger pool bodies 15 may require more sheets 20.

Typically, the sheets 20 are attached at elevations (depths or distances) 30 of about two feet from the lip 35 of the pool body 15, about four feet from the lip 35 of the pool body 15, and about six feet from the lip 35 of the pool body 15. These distances may vary with pool body 15 depth, and some pool bodies 15 may require sheets 20 positioned at only one or two elevations 30. Alternately, the sheets 20 may each be attached at their own individual elevations 30 or distances from the pool body lip 35.

The sheets 20 are typically securely bonded to a pool exterior sidewall 25, such as by an additional application of a fiberglass fusion bonds or volumes 40, by an adhesive material bond 40, or the like.

In operation, the sheets 20 extend from the pool body 15 to which they are secured into the excavation into which the pool body 15 has been placed. Backfill is poured to partially fill the excavation. Respective portions of at least some of the respective sheets 20 (typically those positioned at the lowermost elevations 30 or levels from the lip 35) extend onto the relatively flat, horizontal backfill portion that has partially filled the excavation around the pool body 15, where they are anchored such as by extending anchoring members therethrough, by positioning weighted masses (i.e., more backfill) thereupon, or the like. This process is repeated until all of the sheets 20 have been extended onto backfill and then covered with more backfill and buried and anchored in place. The weight of the backfill material on the sheets 20 generates a frictional anchoring force thereupon that resists movement of the sheets 20, thus creating a pulling force on the pool exterior sidewalls 15 opposing any pushing force generated by the backfill thereagainst.

This process may define a method of stabilizing the sidewalls of a preformed swimming pool body 15, including bonding a first anchor sheet 20 to an exterior surface 25 of a preformed swimming pool body 15 and then extending the first anchor sheet 20 over a first volume of backfill material 45, followed by laying the extended first anchor sheet 20 on a first volume of backfill surface 50 and then burying the extended first anchor sheet 20 under a second volume of backfill material 45. The method is continued by next bonding a second anchor sheet 20 to an exterior surface 25 of a preformed swimming pool body 15, extending the second anchor sheet 20 over the second volume of backfill material 45, laying the extended second anchor sheet 20 on a second volume of backfill surface 50 and finally burying the extended second anchor sheet 20 under a third volume of backfill material 45. Additional elevations 30 of sheets 20 may be added accordingly. The anchor sheet 20 is typically a porous geotextile material. Typically, the first and subsequent anchor sheets 20 each define a plurality of geotextile segments arrayed in a row around the preformed swimming pool body 15 and positioned substantially equidistantly from a top edge 40. The backfill material 45 is typically selected from the group comprising soil, sand, gravel and combinations thereof.

The pool body 15 may be of any convenient shape, including rectangular, generally rectangular, kidney shaped, round, oval, or the like. The sheets 20 may extend from opposing sidewalls 25, adjacent sidewalls 25, from random positions, or the like.

In one alternate embodiment, geotextile sheets 20 are affixed to fiberglass pool bodies 15 already put into the ground. The soil and/or backfill material around the emplaced pool bodies 15 is partially excavated, and one or more geothermal sheets 20 are attached at one end to the pool body sidewall 25, such as with a fiberglass application, adhesive, or the like. The sheets 20 are then extended and the excavated soil and/or backfill is replaced to weight down and bury the one or more sheets 20 to hold them in place and generate the pulling forces on the fiberglass pool sidewall 25.

Figure 5:
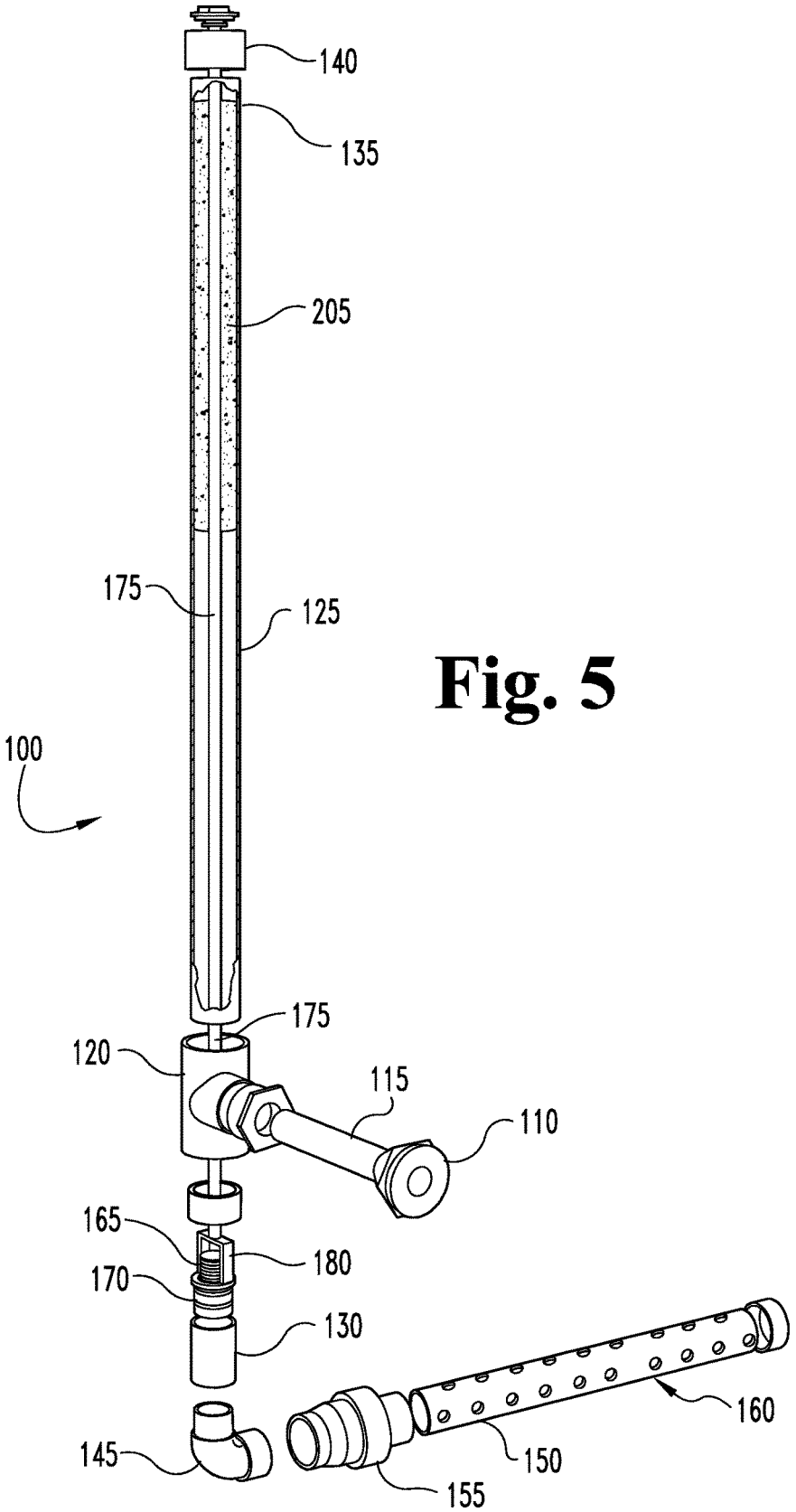
FIG. 5 is an exploded perspective view of a hydro valve system for equalizing hydrostatic pressure without and within a pool body, according to another embodiment of the present novel technology.
Figure 6:
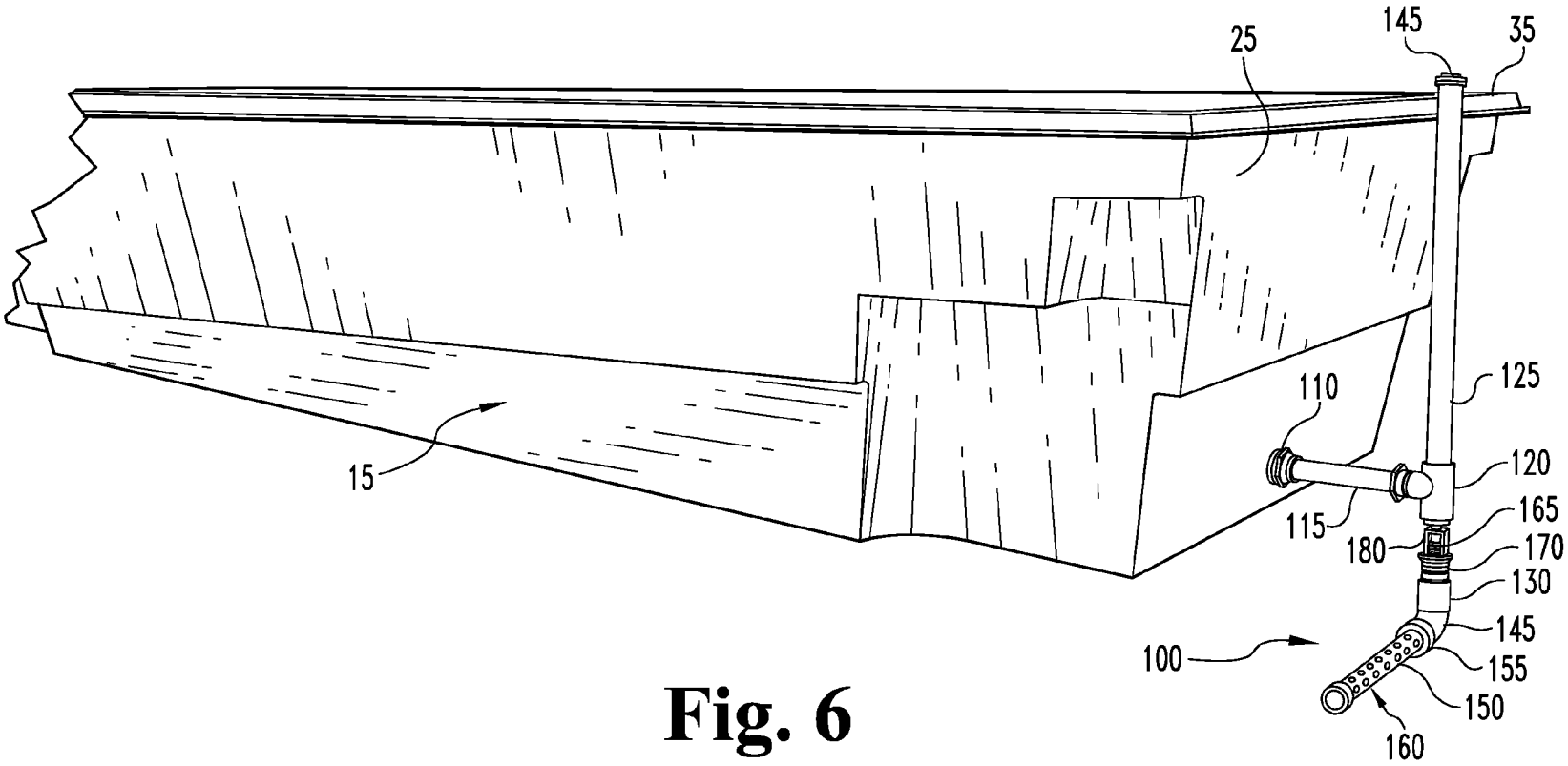
FIG. 6 is a first perspective view of the valve system of FIG. 5 engaged with a pool body.
Figure 7:
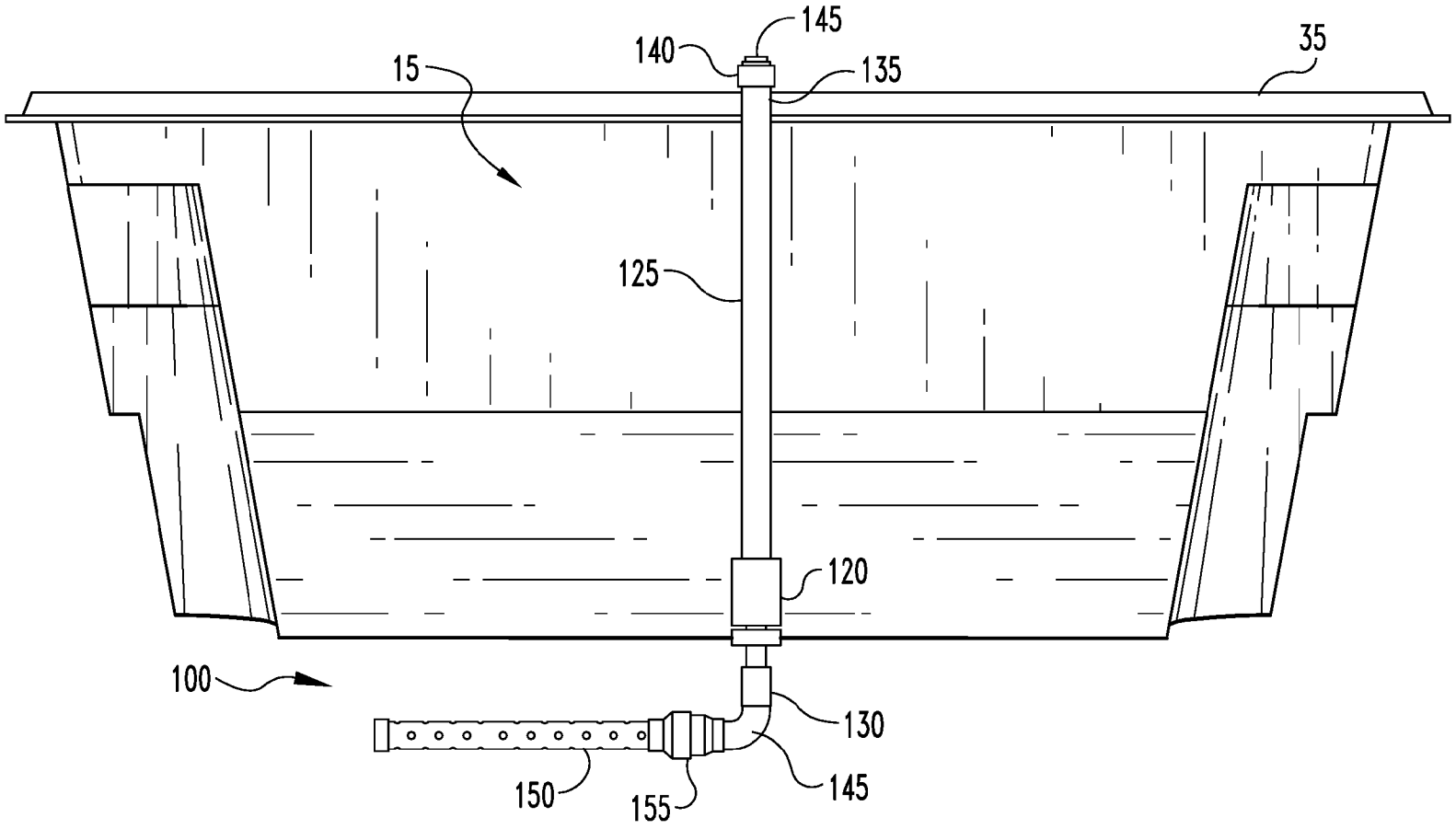
FIG. 7 is a second perspective view of the valve system of FIG. 5 engaged with a pool body.
Figure 8:
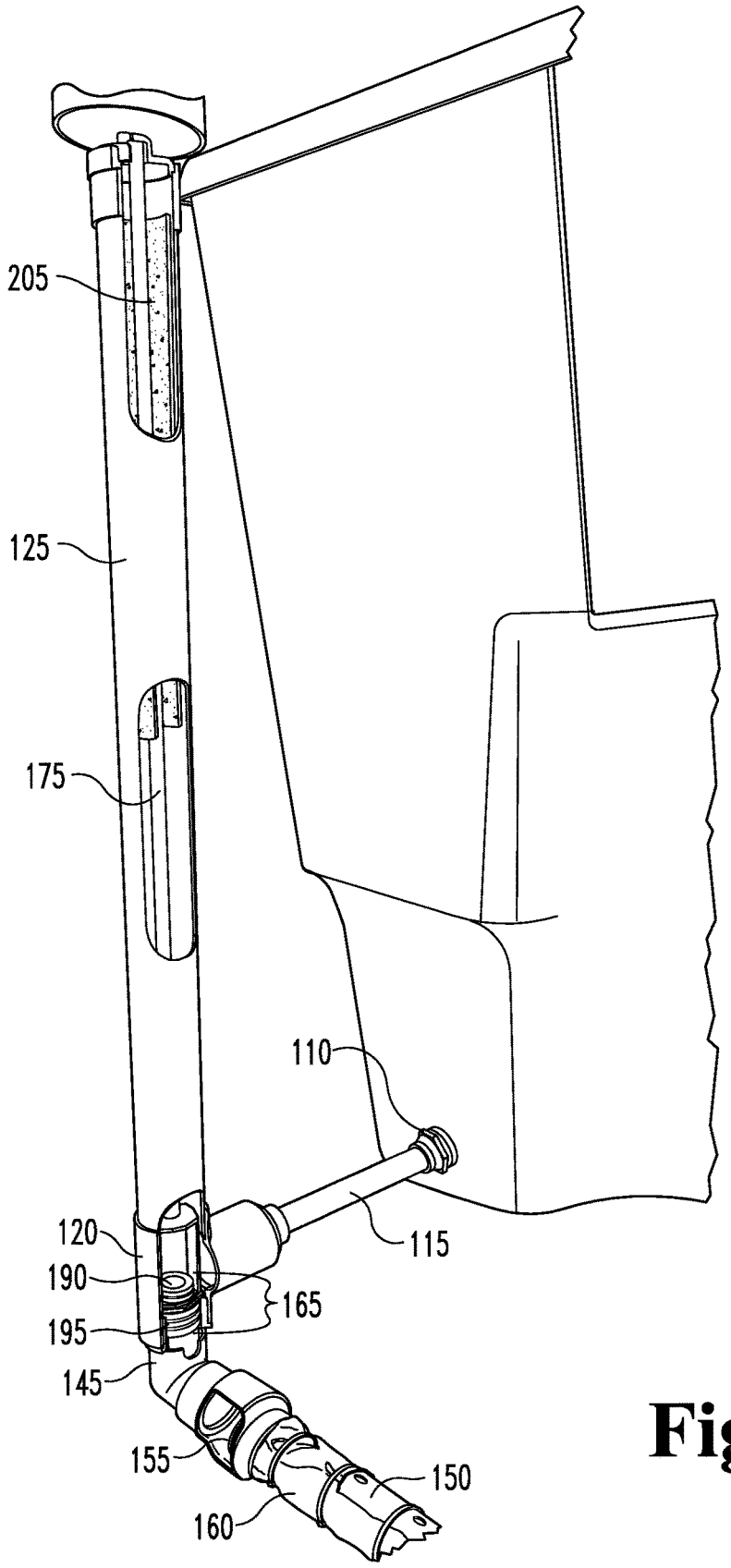
FIG. 8 is an enlarged partial perspective cutaway view of the valve system of FIG. 7.
Figure 9:
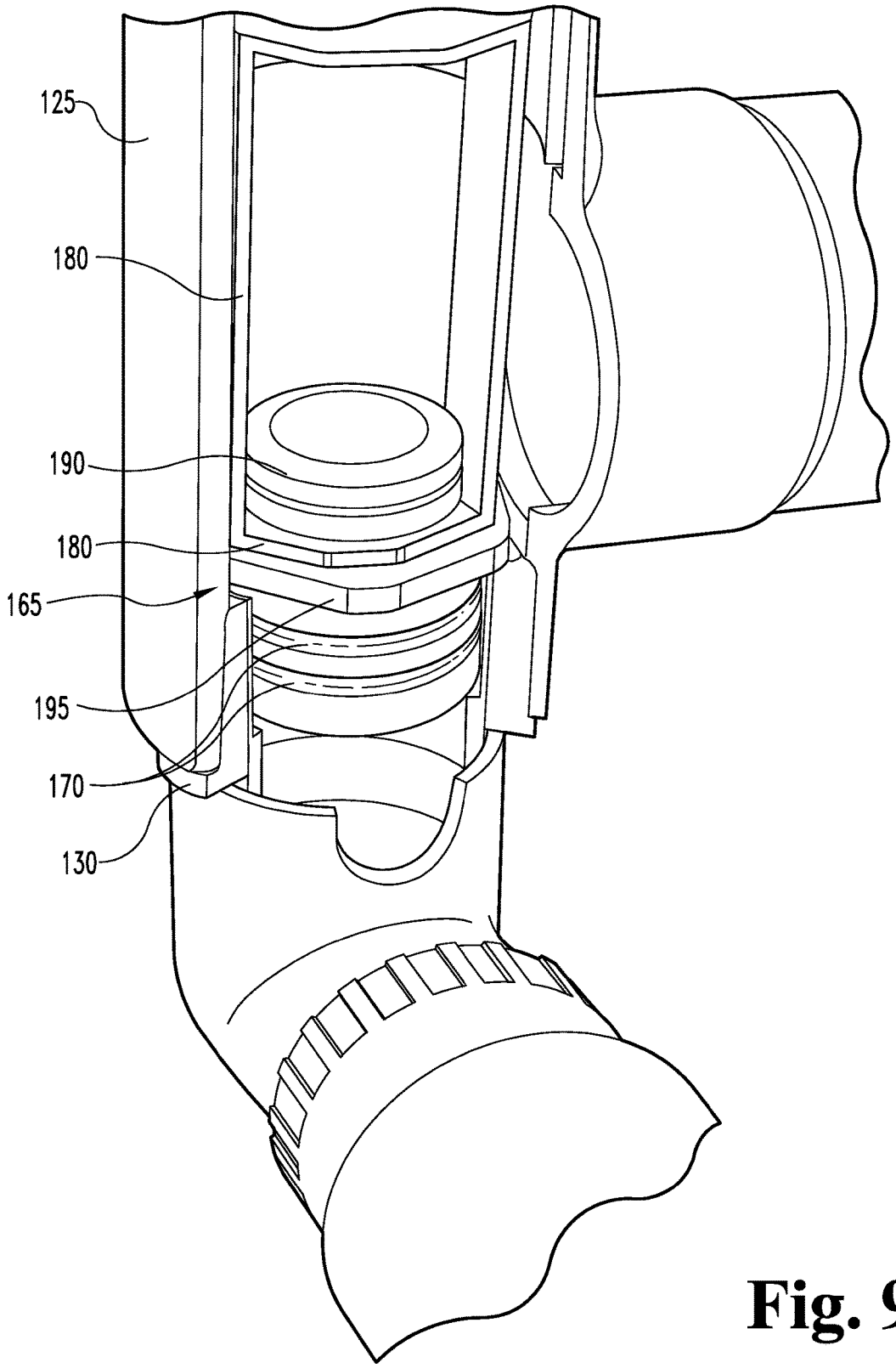
FIG. 9 is an enlarged partial perspective cutaway view of the valve system of FIG. 8.

In another embodiment, as seem in FIGS. 5-9, a hydro valve system 100 is disclosed for equalizing water pressure without and within the pool body 15. The system 100 includes a fluidic access port 110 positioned on or through the pool sidewall and extending therethrough. The port 110 is typically positioned within twenty-four inches of the bottom of the pool body 15, more typically within twelve inches from the bottom of the pool body, and still more typically within 6 inches from the bottom of the pool body. A fluidic conduit 115 extends generally horizontally from the port 110 to a T-junction or like intersection 120 with an elongated fluidic conduit portion 125. The T-junction 120 connects to the fluidic conduit 125, which extends generally vertically away from the T-junction 120 toward the top edge 35, and is typically positioned generally perpendicularly to conduit 115. Fluidic conduit 130 typically extends generally vertically away from the T-junction 120 opposite conduit 125, i.e., away from the top edge 35. Conduit 125 typically includes a (typically threaded) terminal end 135 near the top edge 35 and more typically includes a (typically threaded) cap 140 removably engageable to the terminal end 135.

Conduit 130 typically connects to an L-shaped or like connector or joint 145, which connects at one end to conduit 130 and at the other end to conduit 150 through check valve 155 operationally connected thereonto. Conduit 150 extends perpendicularly to conduit 130, and is typically positioned below the bottom of the pool body, and may be directed away from, parallel to, or under the pool body 15. Conduit 150 is typically perforated or otherwise water permeable, and is more typically covered by a silt sock 160 for allowing passage of water therethrough while blocking particulate matter. The check valve 155 allows for flow from conduit 150 to conduit 130, but not from conduit 130 to conduit 150.

Hydrostatic valve 165 is removably positioned in conduit 130. Typically, conduit 130 defines an inner diameter sized to snugly receive hydrostatic valve assembly 165 in an interference fit. Hydrostatic valve 165 is opened by pressure from and directs water flowing from conduit 150 through check valve 155 and into conduit 130 and on through conduit 115 into the pool body 15, in the event of an excess of build-up of water under the pool body 15. Hydrostatic valve 165 is closed by the flow of water from the pool body 15 through conduits 115 toward conduit 130. The water pressure associated with excess water building up under the pool body 15 is thus relieved by directing the excess water into the pool body 15, reducing the likelihood of the water pressure upwardly urging and displacing the pool body 15.

Hydrostatic valve 165 is held in place in conduits 120 and/or 130 by one or more O-rings 170 or like members snugly encircling valve 165 and participating in an interference fit with conduits 120 and/or 130, resting in preformed grooves or the like, and may be inserted and/or removed through conduit 125, such as by use of an elongated removal tool 175 extending through terminal end 135 to conduit 130. Removal tool 175 is typically an elongated structural member, such as a plastic rod or the like, extending from cap 140 through conduit 125 and terminating in a valve gripping member 180. Valve gripping member 180 is typically a hollow cage housing the valve 165, such that an upward force applied to the cage 180 via the elongated rod 175 urges the hydrostatic valve 165 up and through the conduit 125 where it may be serviced or replaced if necessary. This allows the hydrostatic valve 165 to be pulled, changed, and/or cleaned from the pool deck without the need of personal submersion. The hydrostatic valve 165 is inserted and/or removed without the need of threading. Leakage or removal of the hydrostatic valve 165 does not result in water emptying from the pool body 15.

The hydrostatic valve 165 typically includes a first valve portion 190 connectible to a base portion 195, with the base portion 195 supporting the O-rings 170 for connecting within the conduits 120, 130. Conduits 120 and 130 are typically separate, but in some embodiments may be unitary.

A liner 205, typically a closed-cell foam cylinder (such as a commercial pool noodle) is emplaced in cylinder 125 and positioned to extend from adjacent the cap 145 a sufficient distance downward below the freezing depth to displace groundwater that might otherwise fill cylinder 125 during operation. This liner 205 eliminates the need to 'winterize' conduit 125 by preventing water to rise far enough therein such that it might freeze during cold weather and expand sufficiently to rupture conduit 125.

In operation, the valve assembly 100 is operationally connected to the fluid access port 110 prior to or during placement of the pool body 15 into the ground. The elongated portion extends upwardly generally parallel to the pool body sidewall 25, while conduit 150 typically extends generally perpendicular to the sidewall 25. Conduit 150 is typically positioned below the level of, and more typically generally adjacent to, the pool body 15. The assembly 100 is buried when the pool excavation is backfilled, typically with only the end of elongated conduit 125 and cap 145 protruding above ground.

If the pool, once filled with water, is drained below the level of the ground water surrounding the pool body 15, ground water will flow through conduit 150, through check valve 155 and hydrostatic valve 165 and into the pool body 15 through access port 110. In other words, when the level of the ground water without the pool body 15 is higher than the level of the water within the pool body 15, water will flow thorough the assembly 100 and into the pool body 15 through the access port 110. This prevents damage to the pool body 15 from excessive ground water pressure thereupon, such as bulging of the pool body to the point of cracking or rupture, and/or raising of the entire pool body 15.

Figure 10:
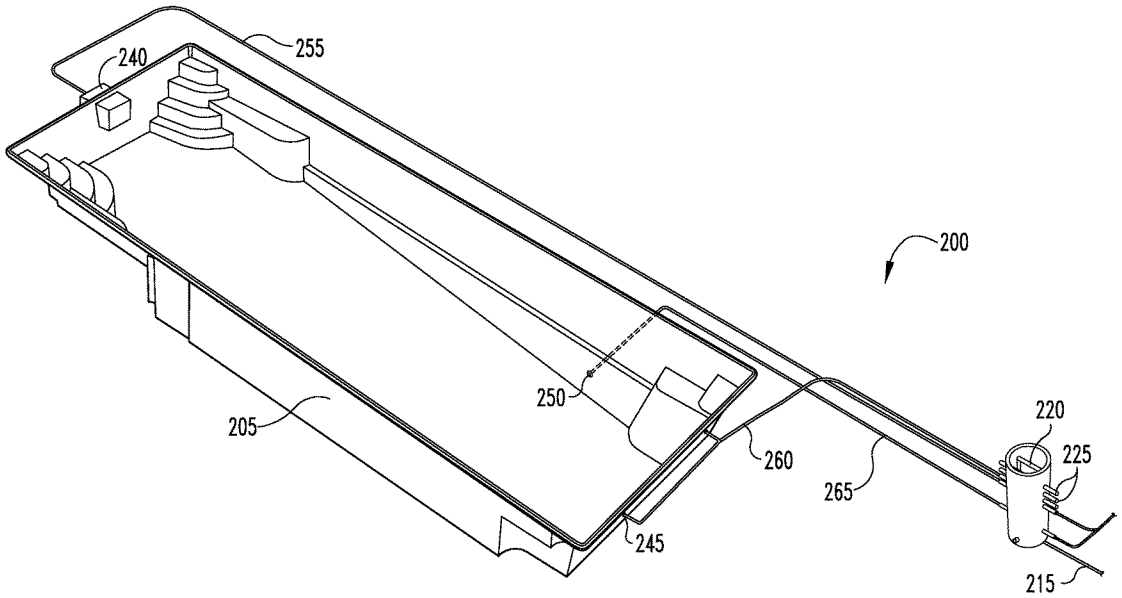
FIG. 10 is a top partial perspective view of another embodiment fiberglass pool winterization assembly of the present novel technology.
Figure 11:
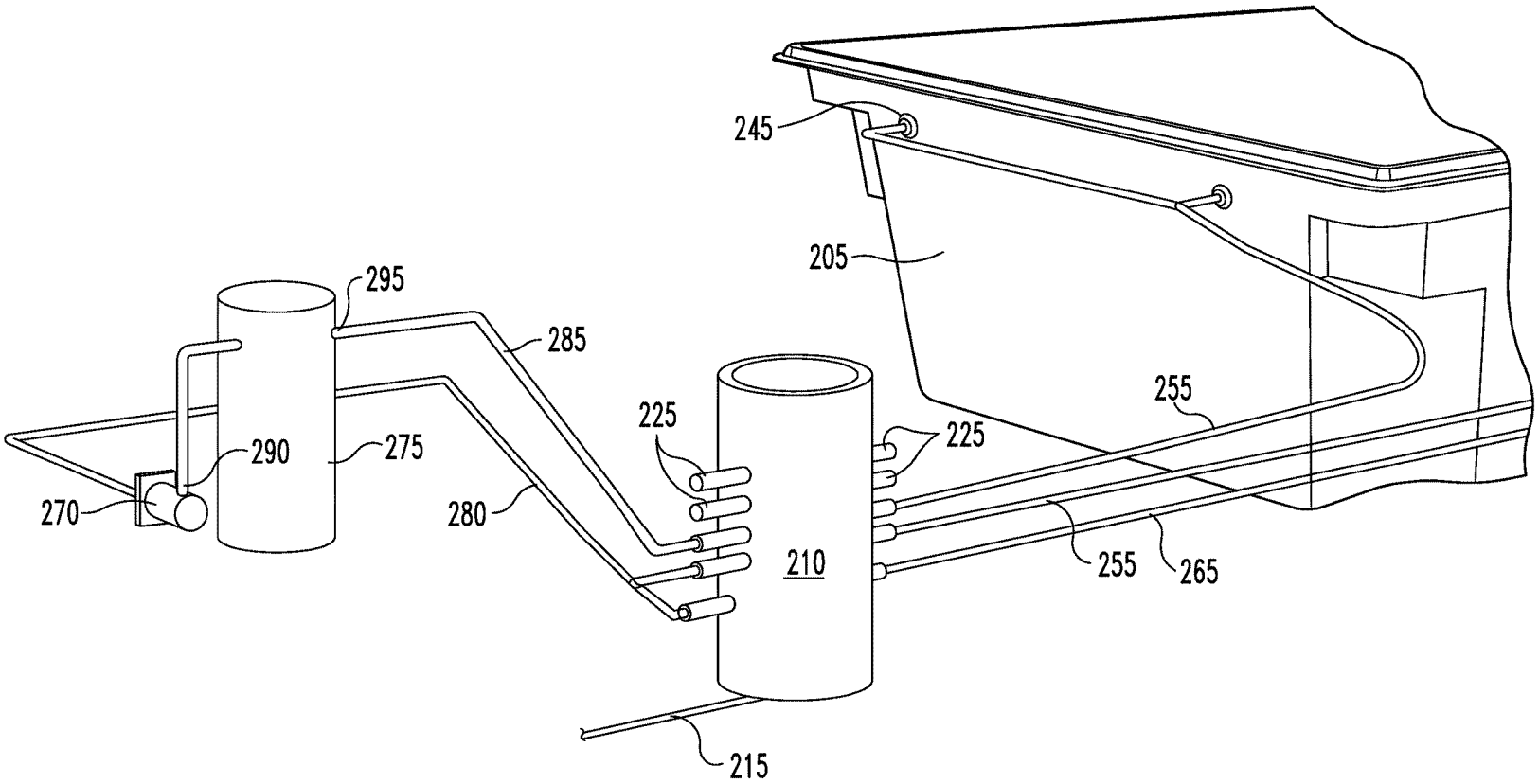
FIG. 11 is a second top partial perspective view of the pool assembly of FIG. 10.
Figure 12:
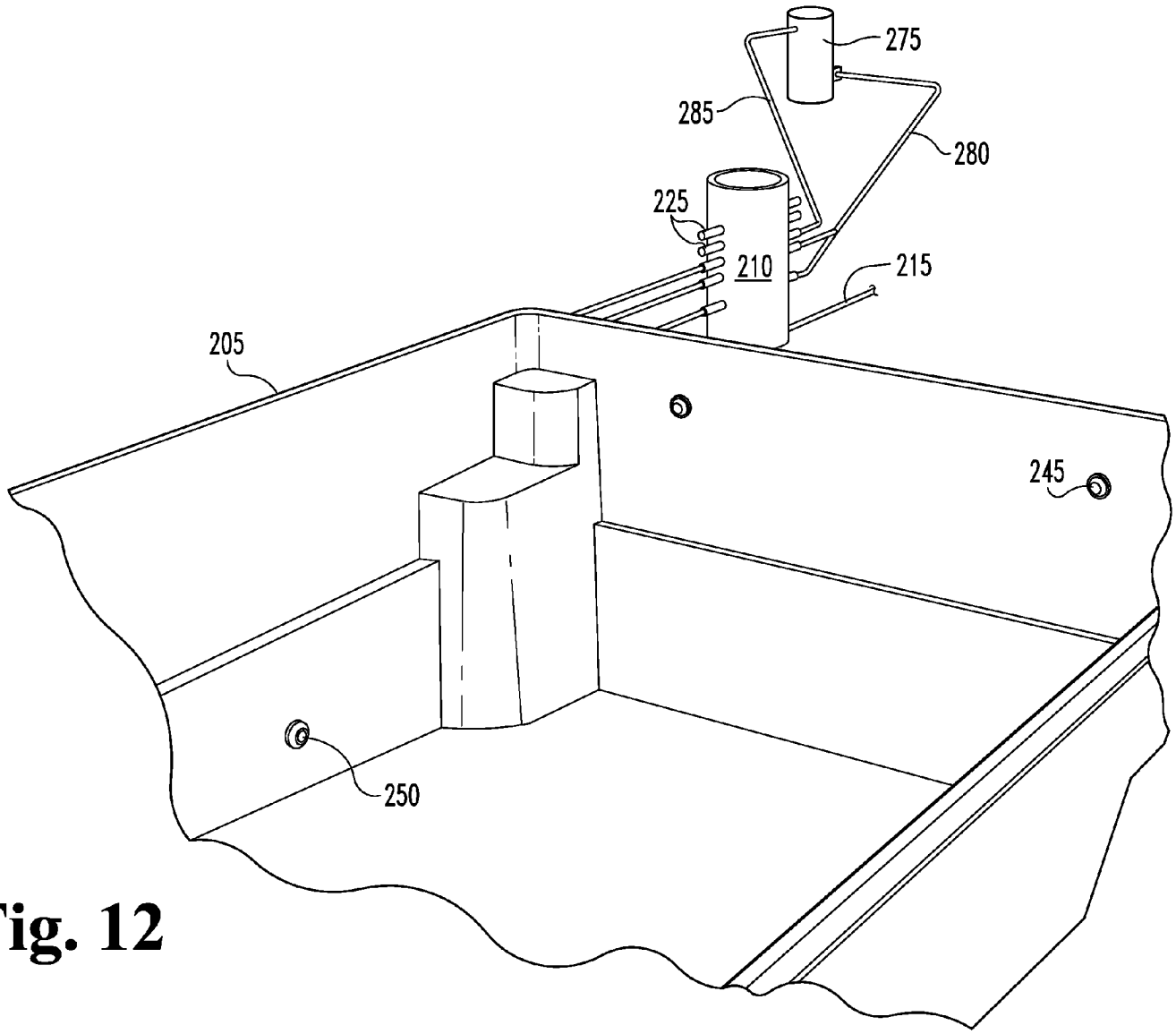
FIG. 12 is a third top partial perspective view of the pool assembly of FIG. 10.
Figure 13:
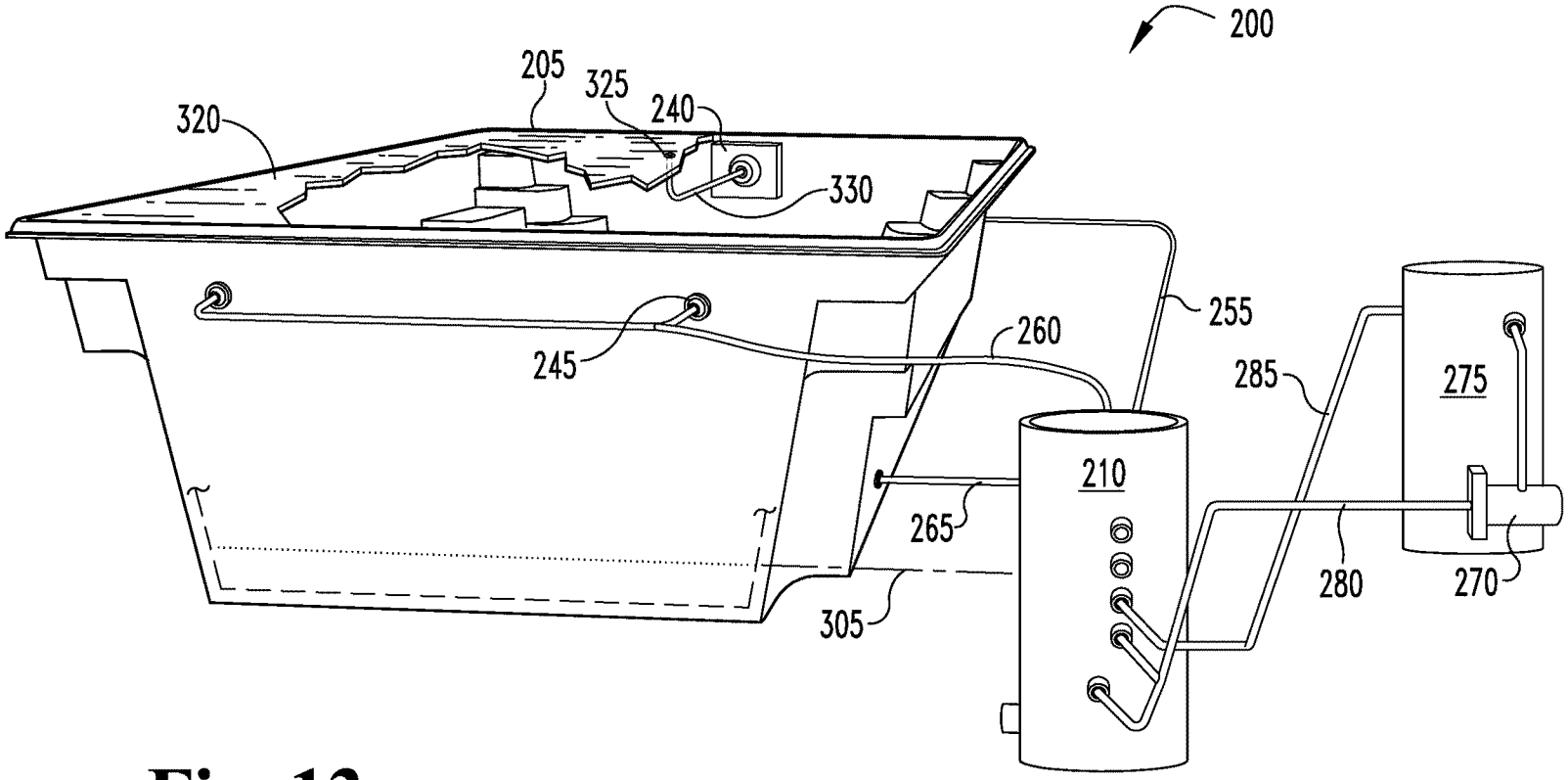
FIG. 13 is a side perspective view of FIG. 10.
Figure 14:
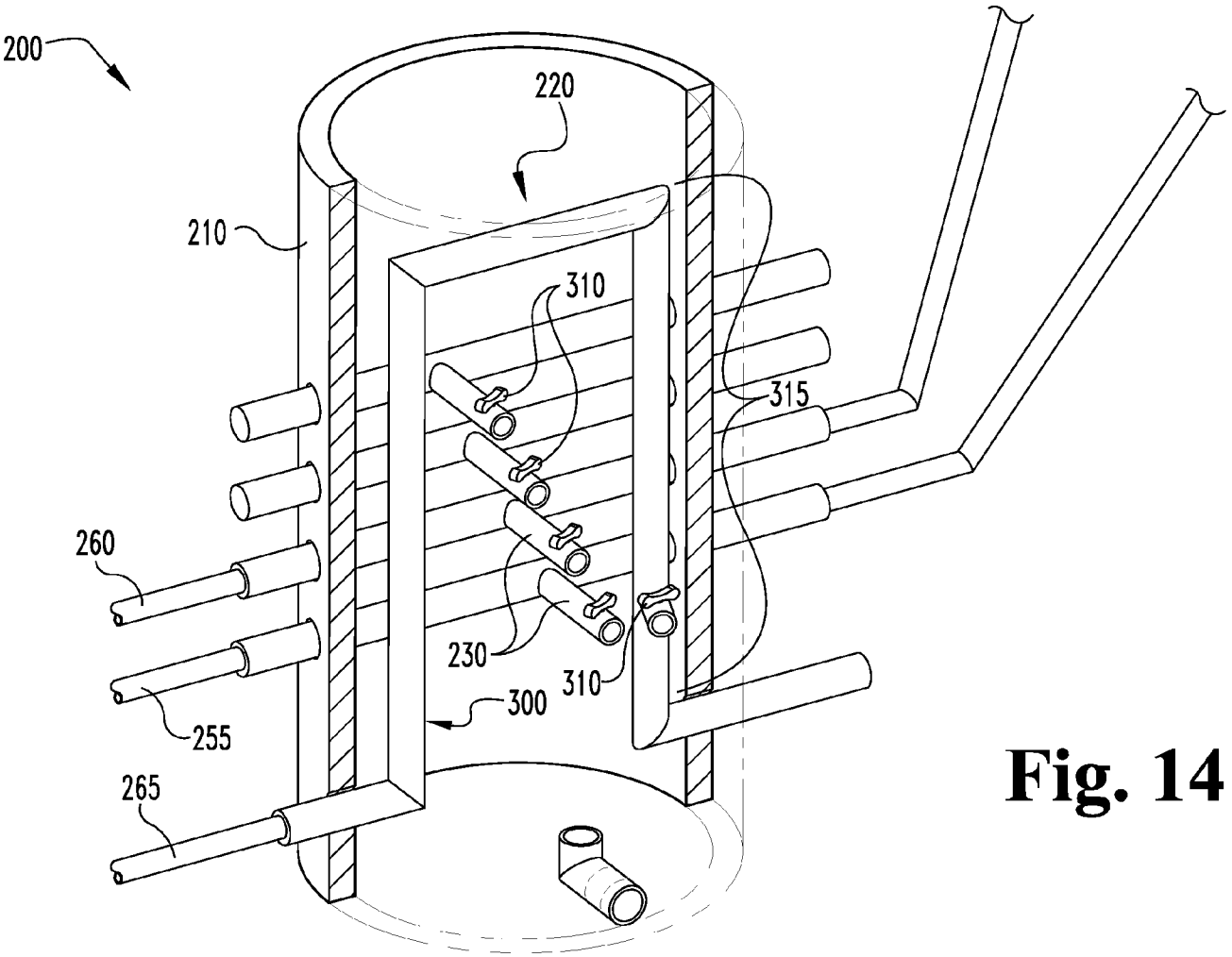
FIG. 14 is top partial perspective cutaway view of the manifold system of FIG. 10.

FIGS. 10-14 relate to a plumbing system 200 for quickly and easily winterizing an in-ground swimming pool 205. The system 200 includes a buried enclosure 210 defining a drainage pit. The enclosure 210 is typically defined by a buried pipe or like structural member. The enclosure 210 typically extends about four feet below ground surface, and is typically about two feet in diameter to accommodate access, although other convenient dimensions may be selected. The enclosure 210 is positioned over, and connected in fluidic communication with, a drain line 215. The drain line 215 is typically a gravity feed drain line, such that water pouring into the drain line 215 automatically flows toward a central drain or reservoir without the need of pumping. The enclosure 210 extends from the surface to below the frost line.

The enclosure 210 further includes a manifold assembly 220 positioned therein. The manifold assembly 220 includes a plurality of fluidic connections or inlets 225 for receiving fluidic inputs, and at least one fluidic outlet 230 connected in fluidic communication with the drain line 215. The fluidic connections 225 typically extend through the enclosure 210 for exterior connection of fluidic conduits. The fluidic outlet 230 is typically positioned below the frost line.

The pool body 205 typically includes at least one skimmer 240, at least one jet inlet 245, and/or a drain outlet 250. The at least one skimmer 240 is typically connected in fluidic communication with a conduit 255, the at least one jet inlet 245 is typically connected in fluidic communication with a conduit 260, and the drain outlet 250 is typically connected in fluidic communication with a conduit 265. Each conduit 255, 260, 265 is respectively connected in fluidic communication to the manifold 220 via a respective inlet 225. The conduits 255, 260, 265 extend downwardly from the pool 205, typically at a fall or slope of no less than one inch for every ten feet of run (or about one percent of one degree). In most cases, the slope will be much greater.

Typically, a water pump 270 is connected to the pool 205, usually through one or more jet inlets 245, and more typically through a filter 275 connected in line with the pump 270 and inlets 245. The pump 270 and/or the filter 275 may be connected in fluidic communication, via respective conduits 280, 285, to respective manifold inlets 225. Typically, the pump 270 includes a drain port 290 that may be connected to conduit 280 and the filter 275 includes drain port 295 that may be connected to conduit 285. In some embodiments, the pump 270 may be operationally connected between the manifold outlet 230 and the drain line 215, such that energization of the pump 270 urges fluid through the drain line 215 and, through the Venturi effect, from the manifold assembly 220, the enclosure 210, and anything connected in fluidic communication therewith.

The drain conduit 265 connects to the manifold assembly 220 through a connector 225 which in turn connects to a manifold conduit 300. Manifold conduit **30*o* typically connects to connector 225 below the target or desired winter water level 305 of the pool 205, and then extends upwardly to a point at or slightly above the desired winter water level 305 of the pool 205, before descending again below the winter water level 305 wherein an outlet 230 is operationally connected, thus forming a waterfall or water lock 315. Valves 310 are typically operationally connected to the outlets 230 to control fluid flow therefrom. During the period of pool operation, such as periods of warmer weather, the valves 310 remain closed. During periods of colder weather, the valves 310 remain open to allow the flow of water from the pool 205 such that all conduits 255, 260 above the frost line drain into the drain line 215** and remain empty.

In some embodiments, the pool 205 has a cover 320 that remains in place while the valves 310 remain open. An aperture 325 is formed in the cover 320, and a typically flexible conduit 330 is connected between the aperture 325 and the skimmer 240 or like fixture, such that water collecting on the cover 320 is automatically drained therefrom, through the skimmer 240 and skimmer conduit 255, through the manifold assembly 220 and out the drain line 215.

In operation, the valves 310 are opened for winterization and are closed again for summer use. Each time the valves are closed, additional water is typically added to the pool to bring the water level up high enough that the water flows out the skimmer 240 for pumping back into the pool 205 via the inlet jet bodies 245 when the pump 270 is energized.

In some embodiments, some or all of the inlet jet bodies 245 are located below the winterization water level 305. A snorkel fitting may be inserted into the jet nozzles 245 positioned below the winterization water level 305 and extend upwardly to above the winterization level 305 to prevent the winterization level from decreasing to the level of the lower-positioned jet nozzles 245.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

I claim:

1. A swimming pool winterization assembly, comprising:

a preformed fiberglass swimming pool body defining a summer waterline and a spaced winter waterline and also defining a top edge and an oppositely disposed bottom portion connected by at least one wall;

a skimmer positioned operationally connected to the at least one wall;

a first conduit fluidically connected to the skimmer and extending away from the swimming pool body;

at least one jet inlet body operationally connected to the at least one wall;

a second conduit fluidically connected to the at least one jet body and extending away from the swimming pool body;

an enclosure;

a manifold assembly positioned within the enclosure and connected in fluidic communication with the first and second conduits;

at least one valve operationally connected to the manifold assembly;

an outlet port operationally connected to the at least one valve;

a drain line positioned in fluidic communication with the outlet port;

wherein the outlet port is positioned below the spaced winter waterline;

wherein when the at least one valve is open, water may drain from the pool, the first conduit and the second conduit through the manifold assembly and through the drain line to allow the maximum water level in the pool to be the winter waterline; and wherein when the at least one valve is closed, the water level in the pool may rise to the summer waterline.

2. The assembly of claim 1 and further comprising:

a drain outlet operationally connected to the swimming pool body;

a third conduit fluidically connected to the drain outlet and extending away from the swimming pool body;

wherein the third conduit is connected in fluidic communication with the manifold assembly below the winter waterline; and wherein the manifold assembly rises above the winter waterline between the third conduit connection and the outlet port to define a waterlock.

3. The assembly of claim 1 and further comprising:

a pump having a pump outlet port connected in fluidic communication with the at least one jet body and a pump inlet port connected in fluidic communication with the skimmer;

a fourth conduit fluidically connected to the pump outlet port and extending away from the swimming pump;

wherein the fourth conduit is connected in fluidic communication with the manifold assembly.

4. The assembly of claim 3 and further comprising:

a water filter having a filter outlet port connected in fluidic communication with the at least one jet body and a filter inlet port connected in fluidic communication with the pump outlet port;

a fifth conduit fluidically connected to the filter outlet port and extending away from the filter;

wherein the fifth conduit is connected in fluidic communication with the manifold assembly.

5. The assembly of claim 1 and further comprising a pool cover operationally connected to the swimming pool body; an aperture formed through the pool cover; and a sixth conduit extending between the aperture and the skimmer for draining water from the pool cover.

6. The assembly of claim 1 and further comprising a plurality of buried geotextile sheets extending from the swimming pool body.

7. A swimming pool assembly plumbed for winterization, comprising:

a swimming pool body having a top edge and an oppositely disposed bottom member connected by at least one sidewall;

a water outlet operationally connected to the at least one wall and defining a high water level;

a first conduit connected in fluidic communication with the water outlet;

at least one jet inlet body operationally connected to the at least one wall;

a second conduit connected in fluidic communication with the at least one jet body;

an at least partially buried pipe;

a first manifold positioned within the pipe and connected in fluidic communication with the first conduit;

a second manifold positioned within the pipe and connected in fluidic communication with the second conduit;

a first valve operationally connected to the first manifold;

a second valve operationally connected to the second manifold;

a first outlet port operationally connected to the first valve;

a second outlet port operationally connected to the second valve;

a drain line positioned in fluidic communication with the respective outlet ports;

wherein when the respective valves are open, water may drain from the pool, the respective conduits, through the respective manifolds and through the drain line to allow the pool body to drain to substantially below the high water level to define a winter water level; and wherein when the respective valves are closed, the water level in the pool may be filled to the high water level.

8. The swimming pool assembly plumbed for winterization of claim 7 and further comprising:

a drain outlet operationally connected to the swimming pool body and spaced from the top edge;

a third conduit connected in fluidic communication with the drain outlet;

a third manifold positioned within the pipe and connected in fluidic communication with the third conduit below the winter level;

a third valve operationally connected to the third manifold; and a third outlet port operationally connected to the third valve;

wherein the third outlet port is positioned below the winter level; and wherein the third manifold rises to the winter water level between the third conduit and the third outlet port to define a waterlock.

9. The swimming pool assembly plumbed for winterization of claim 8 and further comprising:

a pump operationally connected to the at least one jet inlet body and to the water outlet;

a fourth conduit connected in fluidic communication with the pump;

a fourth manifold positioned within the pipe and connected in fluidic communication with the fourth conduit;

a fourth valve operationally connected to the fourth manifold; and a fourth outlet port operationally connected to the fourth valve.

10. The swimming pool assembly plumbed for winterization of claim 9 and further comprising:

a filter operationally connected between the pump and the at least one jet inlet body;

a fifth conduit connected in fluidic communication with the filter;

a fifth manifold positioned within the pipe and connected in fluidic communication with the fifth conduit;

a fifth valve operationally connected to the fifth manifold; and a fifth outlet port operationally connected to the fifth valve.

11. The swimming pool assembly of claim 10 wherein the respective manifolds define a manifold assembly.

12. The swimming pool assembly plumbed for winterization of claim 7 and further comprising:

a pump operationally connected to the at least one jet inlet body and to the water outlet;

a fourth conduit connected in fluidic communication with the pump;

a fourth manifold positioned within the pipe and connected in fluidic communication with the fourth conduit;

a fourth valve operationally connected to the fourth manifold; and a fourth outlet port operationally connected to the fourth valve.

13. The swimming pool assembly plumbed for winterization of claim 12 and further comprising:

a filter operationally connected between the pump and the at least one jet inlet body;

a fifth conduit connected in fluidic communication with the filter;

a fifth manifold positioned within the pipe and connected in fluidic communication with the fifth conduit;

a fifth valve operationally connected to the fifth manifold; and a fifth outlet port operationally connected to the fifth valve.

14. The swimming pool assembly of claim 7 wherein the water outlet includes a skimmer.

15. The swimming pool assembly of claim 7 wherein the at least partially buried pipe has a diameter of about 2 feet; wherein the at least partially buried pipe has a length of about 4 feet; and the wherein the at least partially buried pipe extends below frost line.

16. The swimming pool assembly of claim 7 and further comprising a pool cover operationally connected to the swimming pool body; an aperture formed through the pool cover; and a sixth conduit extending between the aperture and the water outlet for draining water from the pool cover.

17. A swimming pool plumbing assembly, comprising:

a preformed fiberglass swimming pool body defining a top edge and an oppositely disposed bottom portion connected by at least one wall;

a skimmer positioned operationally connected to the at least one wall;

a first conduit fluidically connected to the skimmer and extending away from the swimming pool body;

at least one jet body operationally connected to the at least one wall;

a second conduit fluidically connected to the at least one jet body and extending away from the swimming pool body;

an enclosure;

a manifold assembly positioned within the enclosure and connected in fluidic communication with the first and second conduits;

at least one valve operationally connected to the manifold assembly;

an outlet port operationally connected to the at least one valve;

a third conduit positioned in fluidic communication with the outlet port;

wherein the outlet port is positioned below the skimmer and the at least one jet body;

wherein when the at least one valve is open, water may drain from the pool, the first conduit and the second conduit through the manifold assembly and through the third conduit to allow a maximum water level in the pool to be below the skimmer and the at least one jet body; and wherein when the at least one valve is closed, the water level in the pool may rise to above the at least one jet body.

* * * * *